US008919902B2

(12) United States Patent
Aoki et al.

(10) Patent No.: US 8,919,902 B2
(45) Date of Patent: Dec. 30, 2014

(54) DROPLET DISCHARGING DEVICE AND PARTICLE MANUFACTURING DEVICE

(71) Applicants: Shinji Aoki, Kanagawa (JP); Andrew Mwaniki Mulwa, Kanagawa (JP); Yasutada Shitara, Shizuoka (JP)

(72) Inventors: Shinji Aoki, Kanagawa (JP); Andrew Mwaniki Mulwa, Kanagawa (JP); Yasutada Shitara, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/786,658

(22) Filed: Mar. 6, 2013

(65) Prior Publication Data

US 2013/0241983 A1 Sep. 19, 2013

(30) Foreign Application Priority Data

Mar. 19, 2012 (JP) ..... 2012-061427

(51) Int. Cl.
*B41J 29/38* (2006.01)
*B41J 2/045* (2006.01)

(52) U.S. Cl.
CPC ..... *B41J 2/04541* (2013.01); *B41J 2/04581* (2013.01)
USPC ..... 347/10; 347/68

(58) Field of Classification Search
CPC .... B41J 2/0455; B41J 2/0457; B41J 2/04548; B41J 2/04541
USPC ..... 347/9–11, 68–72
See application file for complete search history.

(56) References Cited

U.S. PATENT DOCUMENTS

| | | | | |
|---|---|---|---|---|
| 6,193,346 | B1 | 2/2001 | Nakano | |
| 6,257,686 | B1 * | 7/2001 | Takahashi et al. | 347/10 |
| 6,523,923 | B2 * | 2/2003 | Sekiguchi | 347/11 |
| 2006/0240354 | A1 | 10/2006 | Ohtani | |
| 2008/0063971 | A1 | 3/2008 | Watanabe et al. | |
| 2009/0226837 | A1 | 9/2009 | Norikane et al. | |
| 2010/0055600 | A1 | 3/2010 | Norikane et al. | |
| 2010/0104970 | A1 | 4/2010 | Norikane et al. | |
| 2010/0227267 | A1 | 9/2010 | Shitara et al. | |
| 2010/0297548 | A1 | 11/2010 | Honda et al. | |
| 2011/0014565 | A1 | 1/2011 | Norikane et al. | |

(Continued)

FOREIGN PATENT DOCUMENTS

| | | |
|---|---|---|
| JP | 1-103449 | 4/1989 |
| JP | 9-023668 | 1/1997 |

(Continued)

*Primary Examiner* — An Do
(74) *Attorney, Agent, or Firm* — Cooper & Dunham LLP

(57) ABSTRACT

A droplet discharging device including a discharging hole to discharge droplets, a piezoelectric element that deforms with electrical charging and discharging to discharge droplets therefrom, a piezoelectric element drive circuit that drives the piezoelectric element to cause it to charge and discharge, wherein the piezoelectric element drive circuit has a control signal generating unit to generate control signals that control outputs of drive signals applied to the piezoelectric circuit and a drive signal output unit to output the drive signals applied to the piezoelectric element based on the control signals, wherein the drive signal output unit includes a first field effect transistor that operates to supply an electric current to the piezoelectric element based on the control signals when charging the piezoelectric element and a second field effect transistor that operates to discharge an electric current from the piezoelectric element based on the control signals when discharging the piezoelectric element.

13 Claims, 6 Drawing Sheets

(56) References Cited

U.S. PATENT DOCUMENTS

| | | | |
|---|---|---|---|
| 2011/0151370 | A1 | 6/2011 | Shitara et al. |
| 2011/0305987 | A1 | 12/2011 | Yohichiroh et al. |
| 2012/0070777 | A1 | 3/2012 | Makabe et al. |
| 2012/0094231 | A1 | 4/2012 | Norikane et al. |
| 2012/0264049 | A1 | 10/2012 | Masuda et al. |
| 2012/0270147 | A1 | 10/2012 | Katoh et al. |
| 2013/0034810 | A1 | 2/2013 | Norikane et al. |

FOREIGN PATENT DOCUMENTS

| | | |
|---|---|---|
| JP | 11-034325 | 2/1999 |
| JP | 2001-063040 | 3/2001 |
| JP | 2006-301427 | 11/2006 |
| JP | 2008-188889 | 8/2008 |
| JP | 2009-292077 | 12/2009 |
| JP | 2011-046027 | 3/2011 |
| JP | 2011-046028 | 3/2011 |

* cited by examiner

DROPLET DISCHARGING DEVICE AND PARTICLE MANUFACTURING DEVICE

CROSS-REFERENCE TO RELATED APPLICATIONS

This patent application is based on and claims priority pursuant to 35 U.S.C. §119 to Japanese Patent Application No. 2012-061427, filed on Mar. 19, 2012 in the Japan Patent Office, the entire disclosure of which is hereby incorporated by reference herein.

BACKGROUND

1. Field

The present invention relates to a droplet discharging device of a recording head for use in an atomizer, applicator, and an inkjet recording device, and a particle manufacturing device, such as a powder manufacturing device or a toner manufacturing device, equipped with the droplet discharging device.

2. Background Art

A recording head serving as a droplet discharging device of an inkjet recording device used as an inkjet printer and an inkjet plotter typically discharges ink droplets from multiple nozzle openings by compressing ink in a compression chamber that communicates with the nozzle openings using pressure generating elements such as piezoelectric elements provided for each of the nozzle openings.

For example, a drive signal generator circuit as illustrated in FIG. 5 is known that generates drive signals to drive the recording head of such an inkjet recording device.

The drive signal generator circuit as illustrated in FIG. 5 has a signal generating circuit 81 to output a charge-discharge pulse 80 to regulate the timing of charge and discharge of a pressure generating element 17, a voltage amplifier circuit 82 for the charge-discharge pulse 80, and an electric current amplifier circuit 83 that, based on the charge-discharge pulse 80, outputs to the pressure generating element 17 a common drive signal COM which is amplified by switching operation of an NPN-type bipolar transistor (hereinafter referred to as NPN transistor) Q1 and a PNP-type bipolar transistor (hereinafter referred to as PNP transistor) Q2, which are push-pull connected.

The pressure generating element 17 is a capacitor C1.

When the drive signal COM is applied to the capacitor C1, the pressure generating element 17 repeatedly charges and discharges based on the drive signal COM.

However, in the typical drive signal generator circuit as illustrated in FIG. 5, since a voltage VO corresponding to the voltage difference between a driving voltage Vcc or a ground GND and the drive signal COM is simply applied as is across the collector-emitter of the NPN transistor Q1 or the PNP transistor Q2 when discharging or charging in the electric current amplifier circuit 83, the amount of heat generation of the NPN transistor Q1 and the PNP transistor Q2 is large.

As a result, a large-scale heat discharging device is required to discharge the heat of the NPN transistor Q1 and the PNP transistor Q2, resulting in a larger-than-necessary printer.

JP-2001-063040-A and JP-2011-046028-A disclose an inkjet recording device and a liquid spraying device equipped with a drive signal generator circuit that reduces heat generation by reducing the power consumption of the transistors of the electric current amplifier circuit.

In the inkjet recording device of JP-2001-063040-A mentioned above, as illustrated in FIG. 6, a primary coil L1 of a transformer 90 is electrically connected between the collector of the NPN transistor Q1 of a push-pull circuit 830 and the driving voltage Vcc.

A secondary coil L2 of the transformer 90 is electrically connected between the collector of the PNP transistor Q2 and the ground GND.

This configuration makes it possible to reduce the emitter-collector voltage of the NPN transistor Q1 and the PNP transistor Q2A when charging and discharging.

The liquid spraying device of JP-2011-046028-A mentioned above, as illustrated in FIG. 7, has a (digital) drive signal generating unit 70 to supply an electric current to a piezoelectric element PZT by an inductor storing energy and to operate the piezoelectric element PZT by discharging electric current from the piezoelectric element PZT.

This configuration makes it possible to reduce the power consumption of an NPN transistor 821 and a PNP transistor 822 of the electric current amplifier circuit.

JP-2009-292077-A discloses an image forming apparatus equipped with a drive signal generator circuit that improves energy efficiency by re-using the electric charge of the discharge from the piezoelectric element.

The drive signal generator circuit of JP-2009-292077-A mentioned above, as illustrated in FIG. 8, has a capacitor C2 charged by the electric charge from discharging of a piezoelectric element C1 and multiple switching elements including a switching element S2 that switches the connection of the terminal on the reference voltage side of the capacitor C2 between ground and a negative power source-E.

Also, since a driving current charge-discharge circuit 30*c* is provided which re-uses the electric charge charged at the capacitor C2 for the piezoelectric element C1, energy efficiency is improved.

However, although the inkjet recording device of JP-2001-063040-A mentioned above has the transformer 90 including the two coils of L1 and L2, it still requires a large-scale heat discharging and cooling mechanism because reducing the heat generation of the NPN transistor Q1 and the PNP transistor Q2 is insufficient.

Consequently, size reduction of the device is not to be expected.

Similarly, the liquid spraying device of JP-2011-046028-A mentioned above is successful in reducing the heat generation of an NPN transistor 821 and a PNP transistor 822, a circuit (drive signal generating unit 70) is newly added, so that here too size reduction of the device is not to be expected. Moreover, the image forming apparatus of JP-2009-292077-A mentioned above is successful in improving energy efficiency but two switching elements are newly added.

Since these switching elements generate heat, it is not possible to obviate the need for a heat discharging and cooling mechanism, which again limits the size reduction.

Unlike the inkjet recording device, any of the atomizer, the applicator, the powder manufacturing device, and the toner manufacturing device can discharge ink from all the nozzles simultaneously. For this reason, it is preferable to put all the channels (typically more than several hundred) provided to a liquid discharging device (head) together and drive them by a single drive signal generator circuit instead of switching all the channels on/off separately.

However, the driving current to operate the piezoelectric element is several hundreds of times as great as the case of switching all the channels on/off separately, which leads to a large amount of heat generation of the drive signal generator circuit.

Furthermore, different from the inkjet recording device, these devices continue discharging droplets during operation, which increases the amount of heat generated.

SUMMARY

The present invention provides a droplet discharging device including a discharging hole to discharge droplets, a piezoelectric element that deforms with electrical charging and discharging to discharge droplets from the discharging hole, a piezoelectric element drive circuit that drives the piezoelectric element to cause the piezoelectric element to charge and discharge, wherein the piezoelectric element drive circuit has a control signal generating unit to generate a control signal that controls outputs of a drive signal applied to the piezoelectric circuit and a drive signal output unit to output the drive signal applied to the piezoelectric element based on the control signal, wherein the drive signal output unit includes a first field effect transistor that operates to supply an electric current to the piezoelectric element based on the control signal when charging the piezoelectric element and a second field effect transistor that operates to discharge an electric current from the piezoelectric element based on the control signal when discharging the piezoelectric element.

BRIEF DESCRIPTION OF THE DRAWINGS

Various other objects, features, and attendant advantages of the present invention will be more fully appreciated as the same become better understood from the detailed description when considered in connection with the accompanying drawings, in which like reference characters designate like corresponding parts throughout and wherein.

DETAILED DESCRIPTION

An embodiment of the toner manufacturing device equipped with the droplet discharging device related to the present disclosure is described with reference to the accompanying drawings.

Figure 1:
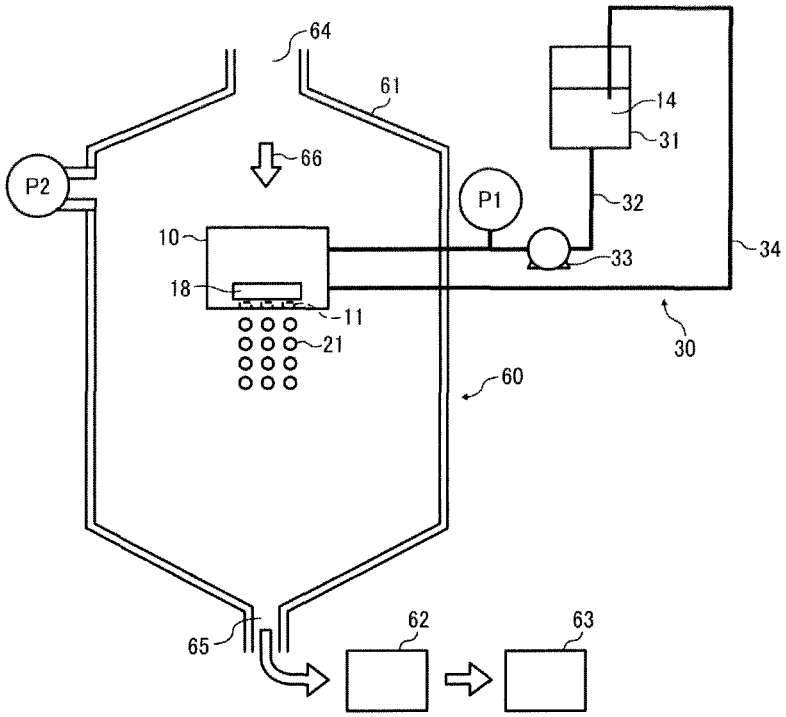
FIG. 1 is a schematic diagram illustrating an example of a toner manufacturing device equipped with a droplet discharging device related to an embodiment of the present disclosure.

FIG. 1 is a schematic diagram illustrating an example of a toner manufacturing device equipped with a droplet discharging device related to an embodiment of the present disclosure.

This toner manufacturing device has a droplet discharging device 10 and a drying collecting device 60, and a toner component replenishing device 30.

The toner component replenishing device 30 has a toner liquid component tank 31 that stores a toner liquid component 14.

The toner liquid component tank 31 is connected to the droplet discharging device 10 via a toner liquid component supplying fluid path 32.

A fluid circulating pump 33 that transfers the toner liquid component 14 in the toner liquid component supplying fluid path 32 with pressure is connected to the toner liquid component supplying fluid path 32.

By driving the fluid circulating pump 33, the toner liquid component 14 in the toner liquid component tank 31 is supplied to the droplet discharging device 10 via the toner liquid component supplying fluid path 32.

In addition, the toner liquid component tank 31 is connected to the droplet discharging device 10 via a fluid returning tube 34.

Among the toner liquid component 14 supplied from the toner liquid component supplying fluid path 32 to the droplet discharging device 10, the toner liquid component 14 that has not replenished a liquid column resonance liquid chamber 18 of the droplet discharging device 10 is returned to the toner liquid component tank 31 via the fluid returning tube 34 by driving of the fluid circulating pump 33.

In this embodiment, there is provided a pressure gauge P1 to the toner liquid component supplying fluid path 32 and a pressure gauge P2 to the drying collecting device 60.

The liquid transfer pressure to the droplet discharging device 10 and the pressure in the drying collecting device 60 are controlled by the readings from the pressure gauges P1 and P2.

If the pressure of the pressure gauge P1 is greater than that of the pressure gauge P2, the toner liquid component 14 may ooze from a discharging hole 11.

By contrast, if the pressure of the pressure gauge P is smaller than that of the pressure gauge P2, an air enters inside the droplet discharging device 10, which may halt discharging.

Consequently, it is preferable that the pressure at the pressure gauge P1 is equal to the pressure at the pressure gauge P2.

A chamber 61 is provided to the drying collecting device 60 and the droplet discharging device 10 is provided in this chamber 61.

In the chamber 61, a downward air (transfer air) stream 66 flows in the chamber 61 from a transfer air stream intake port 64.

A droplet 21 discharged from the discharging hole 11 in the droplet discharging device 10 is transferred downward not only by the gravity but also this downward air 66.

The droplet transferred downward in the chamber is dried and solidified during the transfer, discharged from a collecting exit 65, sent to a solidified particle collecting device 62, and finally collected.

Thereafter, the particle collected at the solidified particle collecting device 62 is sent to a drying device 63, where secondary drying is optionally conducted.

If the discharged droplets contact each other before drying, the droplets coalesce into a large particle, resulting in a wide toner particle size distribution. Therefore, to obtain toner particles having a sharp particle size distribution, it is required to secure the distance between the discharged droplets.

However, the discharged droplets have a constant initial velocity but gradually lose momentum due to air resistance.

Consequently, the droplet discharged later catch up with the droplet that has lost momentum in some cases, which lead to coalescence.

This coalescence occurs constantly, so that if such particles are collected, the particle size distribution greatly deteriorates.

In this embodiment, the downward air 66 prevents such momentum loss of the droplets to separate them from each other.

With regard to the droplet discharging device 10, it is possible to use various discharging devices such as a film vibration type discharging device, a liquid vibration type discharging device, and a liquid column resonance type discharging device.

However, as described above, these devices have a problem in that the heat generation is large in the drive signal generator circuit that drives a pressure oscillator to discharges the droplets.

In this embodiment, a field effect transistor (FET), which is capable of fast switching, is used instead of a typical transistor.

Figure 2:
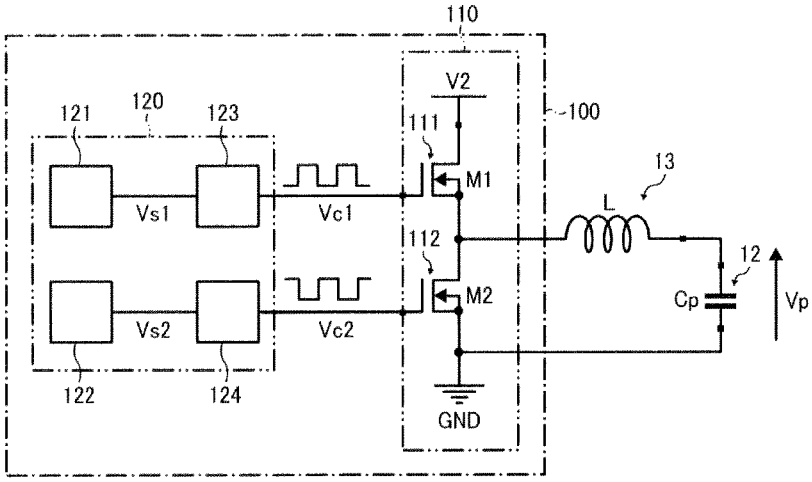
FIG. 2 is a block diagram illustrating an example of configuration of a piezoelectric drive circuit of a droplet discharging device related to an embodiment of the present disclosure.

FIG. 2 is a block diagram illustrating an example of configuration of a piezoelectric drive circuit 100 of the droplet discharging device 10 related to an embodiment of the present disclosure.

In FIG. 2, the piezoelectric drive circuit 100 has a control signal generating unit 120 to generate control signals Vc1 and Vc2 that controls the output of the drive signal applied to a piezoelectric element 12 and a drive signal output unit 110 that outputs the drive signal applied to the piezoelectric element 12 based on the control signals Vc1 and Vc2, In the drive signal output unit 110, a high side FET 111 (M1) for charging serving as the first field effect transistor and a low side FET 112 (M2) for discharging serving as the second field effect transistor are connected serially to an output voltage V2 of a direct electric current and the piezoelectric element 12 is connected therebetween (the connecting point) via an inductor 13.

The high side FET 111 and the low side FET 112 are independently controlled by the control signals Vc1 and Vc2, respectively, from the control signal generating unit 120. The control signal generating unit 120 has a drive circuit 123 for high side FET to generate the control signals Vc1 based on a reference signal Vs1 for high side generated at a reference signal generator 121 for high side serving as the first reference signal generating unit and a drive circuit 124 for low side FET to generate the control signals Vc2 based on a reference signal Vs2 for low side generated at a reference signal generator 122 for low side serving as the second reference signal generating unit.

The drive circuit 123 for high side FET that generates the control signals Vc1 is connected to the gate serving as the control terminal of the high side FET 111.

The drive circuit 124 for low side FET that generates the control signals Vc2 is connected to the gate serving as the control terminal of the low side FET 112.

In the piezoelectric drive circuit 100 having the configuration described above, the phases of the reference signal Vs1 for high side and the reference signal Vs2 for low side that are generated at the respective reference signal generators 121 and 122, etc. are adjusted to avoid a situation in which both the high side FET 111 and the low side FET 112 are on simultaneously. If the voltage applied to the piezoelectric element 12 is Vp, for example, as shown in Table 1, the high side FET 111 and the low side FET 112 are switched on and off by the control signals Vc1 and Vc2, so that the voltage applied to the piezoelectric element 12 changes and the piezoelectric element 12 charges and discharges, resulting in vibration of the piezoelectric element 12.

TABLE 1

| Highside FET for charge | Lowside FET for discharge | State of piezoelectric element | Voltage of piezoelectric element |
|---|---|---|---|
| ON | OFF | Charge | Surge Until Vp = V2 |
| OFF | OFF | No change | Vp = V2 |
| OFF | ON | Discharge | Nosedive until Vp = 0 |
| OFF | OFF | No change | Vp = 0 |

Figure 3:
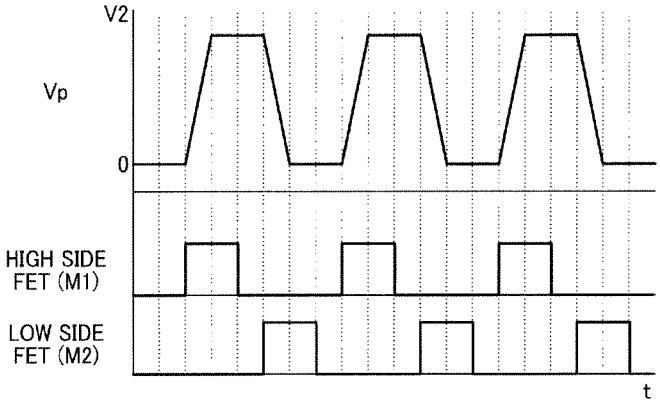
FIG. 3 is a timing chart illustrating a relation between the drive signal of a high side field effect transistor (FET) and a low side FET and the voltage of a piezoelectric element.

When driving the high side FET 111 and the low side FET 112 is repeated in a constant cycle (frequency: f), as illustrated in FIG. 3, the voltage Vp applied to the piezoelectric element 12 changes to have a trapezoid form with little rising noise.

In the drive signal output unit 110 of the piezoelectric drive circuit 100, an electric current is supplied to the piezoelectric element 12 by the high side FET 111 operating based on the control signals Vc1 when charging the piezoelectric element 12.

In addition, when discharging the piezoelectric element 12, an electric current is discharged from the piezoelectric element 12 by the low side FET 112 operating based on the control signals Vc2.

By using the high side FET 111 and the low side FET 112 operating in such a manner, no electric current flows at all between the source and the drain on the output side while the voltages of the control signals Vc1 and Vc2 are applied between the gate and the drain on the input side of the drive signal output unit 110 and no voltage is applied at all between the gate and the drain on the input side while an electric current flows between the source and the drain on the output side.

Consequently, the heat generation in the drive signal output unit 110 of the piezoelectric drive circuit 100 can be reduced to practically nil in comparison with that of a typical transistor. The amount of the heat generation in the piezoelectric drive circuit 100 that drives the piezoelectric element 12 is reduced without adding a new circuit, which obviates the need for a large heat discharging and cooling mechanism.

Alternatively, it is possible to have a configuration without a heat discharging and cooling mechanism, which makes it possible to configure a small device.

In addition, since the temperature inside the device is stabilized, the impact on the viscosity of the discharging fluid decreases, so that the diameter of the discharging droplets does not vary greatly.

Whereas in a typical piezoelectric drive circuit there is a prerequisite that a selected set of different kinds of bipolar transistors of the NPN transistor and the PNP transistor is used, the piezoelectric drive circuit 100 of this embodiment uses the same kind of FETs, which are the high side FET 111 and the low side FET 112.

This facilitates inventory management and reduces costs.

However, different from the bipolar transistor that is capable of being driven by a trapezoid or sine wave, an FET has a problem in that it has only a square drive wave.

To solve this problem, the inductor 13 having a particular value is inserted serially with the piezoelectric element 12 serving as the load.

This inductor 13 inhibits abrupt inflow and outflow of the electric current and significantly reduces the ringing noise that occurs when the FET is turned on.

When driving on a frequency 100 kHz or higher, a trapezoid or sine waveform is shown.

In particular, the durability of the piezoelectric element 12 becomes a problem when continuously operating a piezoelectric element in, for example, a toner manufacturing device and an atomizer.

Also, when using the piezoelectric element 12 made of a piezoelectric material, a drive waveform is desired which has no abrupt change in terms of peeling-off of the layered piezo.

This can be solved by inserting the inductor 13, thereby improving the durability of the piezoelectric element 12 by changing driving form to a trapezoid or a sine waveform.

Furthermore, this leads to manufacturing no fine powder or satellites smaller than a desired droplet diameter, which makes it possible to manufacture toner particles having a sharp particle size distribution.

It is also found that the waveform changes greatly depending on the electrostatic capacity Cp and the driving frequency f of the piezoelectric element 12 serving as the load.

Therefore, it is preferable to change the size of the self inductance L of the inductor 13 to be inserted depending on the driving condition.

Since the electrostatic capacity Cp and the driving frequency f of the toner manufacturing device are unchanged in the toner manufacturing device, it is suitable to determine the size of the self inductance L of the inductor 13 based on the electrostatic capacity Cp and the driving frequency f for operation of the piezoelectric element 12.

This also applied not only to the toner manufacturing device but also to the atomizer, the applicator, the powder manufacturing device, etc.

However, considering the capacity of the cable connected to the piezoelectric element 12 and the piezoelectric drive circuit 100 and floating capacity, the electrostatic capacity Cp of the piezoelectric element 12 is not correctly measured until these are actually assembled.

Therefore, it is suitable to obtain a relation that determines the target value as an indicator for the size of the self inductance L of the inductor 13.

The minimum of the synthetic impedance of L and C in the operating driving frequency f (Hz) is set as the target value. When the self inductance of the inductor 13 is set as L (H) and the electrostatic capacity of the piezoelectric element 12 is set as Cp (F), the target value satisfies the following relation 1.

$$j(2\pi f)L+1/j(2\pi f)Cp=0 \qquad \text{Relation 1}$$

When the value of L that satisfies the relation 1 is Lo, Lo is represented by the following relation 2:

$$Lo=1/(4\pi^2 \cdot f^2 \cdot Cp) \qquad \text{Relation 2}$$

When assembling the piezoelectric drive circuit 100 by inserting the inductor 13 having a self inductance L of Lo, monitor the waveform of the actual voltage and electric current to make an adjustment of increasing Lo if reducing the noise component or rendering the waveform to a sine waveform is desired.

Moreover, to improve the response, make an adjustment of decreasing Lo.

As a result of such adjustments, it is found that, in terms of the response and removal of the noise, it is good if the value of the self inductance L of the inductor 13 satisfies the following relation 3 and more preferably the following relation 4.

In the relations 3 and 4, Lo is the same as in the relation 2 shown above.

$$\tfrac{1}{2}Lo \le L \le 2Lo \qquad \text{Relation 3}$$

$$0.7Lo \le L \le 1.3Lo \qquad \text{Relation 4}$$

That is, it is suitable to set the value of the self inductance L of the inductor 13 in a range of from a half to twice Lo and preferably from 0.7 to 1.3 Lo.

By satisfying the relations 3 and 4, the synthetic impedance including the inductor 13 decreases, so that the piezoelectric element 12 can be driven by a small voltage.

As a result, it is possible to reduce the heat generation in the piezoelectric drive circuit 100, which obviates the need for a large-sized power source and contributes to manufacture a compact device.

Specifically, when an output voltage V2 of the direct current of 8 (V), a self inductance L of the inductor 13 of 1.4 (μH), an electrostatic capacity Cp of the piezoelectric element 12 of 192 (nF), and a driving frequency f of 330 (kHz) are assigned to the relation, the calculation value of Lo is 1.21 (μH).

Since the self inductance L of the inductor 13 actually adopted is 1.4 (μH), meaning 16% greater than the calculation value, it is within the range of the relations 3 and 4.

Variation 1

In the embodiment described above, signal generators are provided to the high side FET 111 and the low side FET 112 individually, which requires two reference signal generators. However, a single signal generator will suffice.

Figure 4:
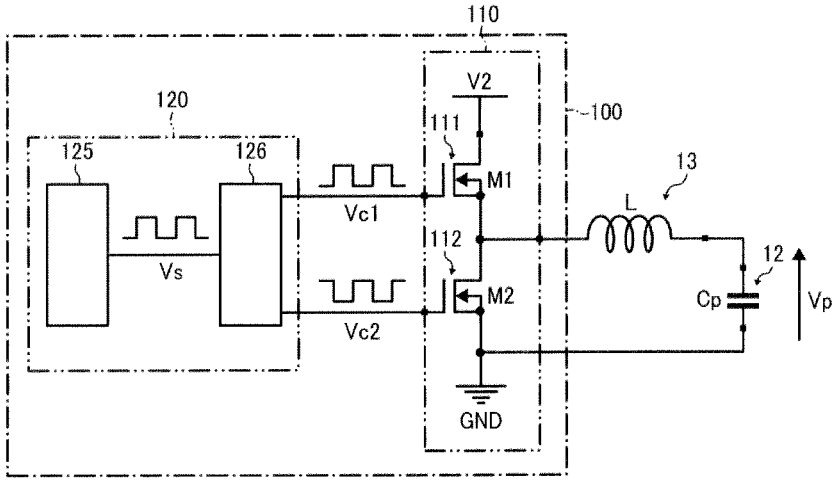
FIG. 4 is a block diagram illustrating an example of configuration of a drive signal generator circuit related to a variation of the present disclosure.
Figure 5:
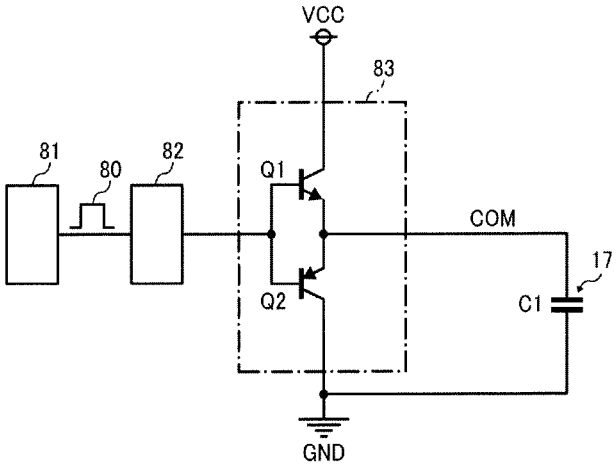
FIG. 5 BACKGROUND ART
FIG. 5 is a block diagram illustrating an example of configuration of a drive signal generator circuit related to the background art.
Figure 6:
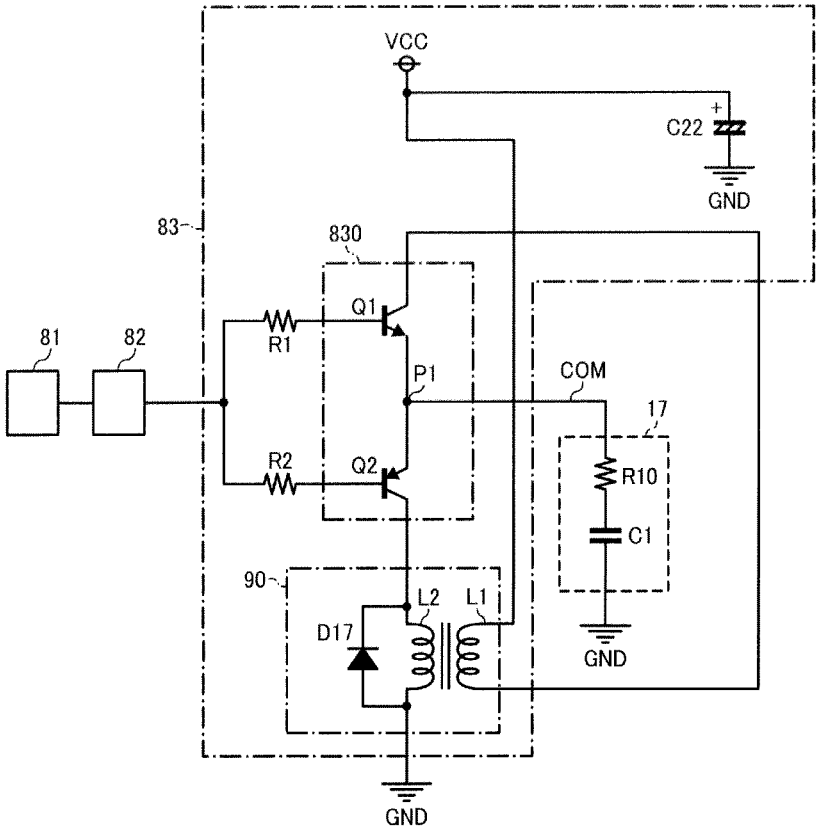
FIG. 6 BACKGROUND ART
FIG. 6 is a block diagram illustrating another example of configuration of a drive signal generator circuit related to the background art.
Figure 7:
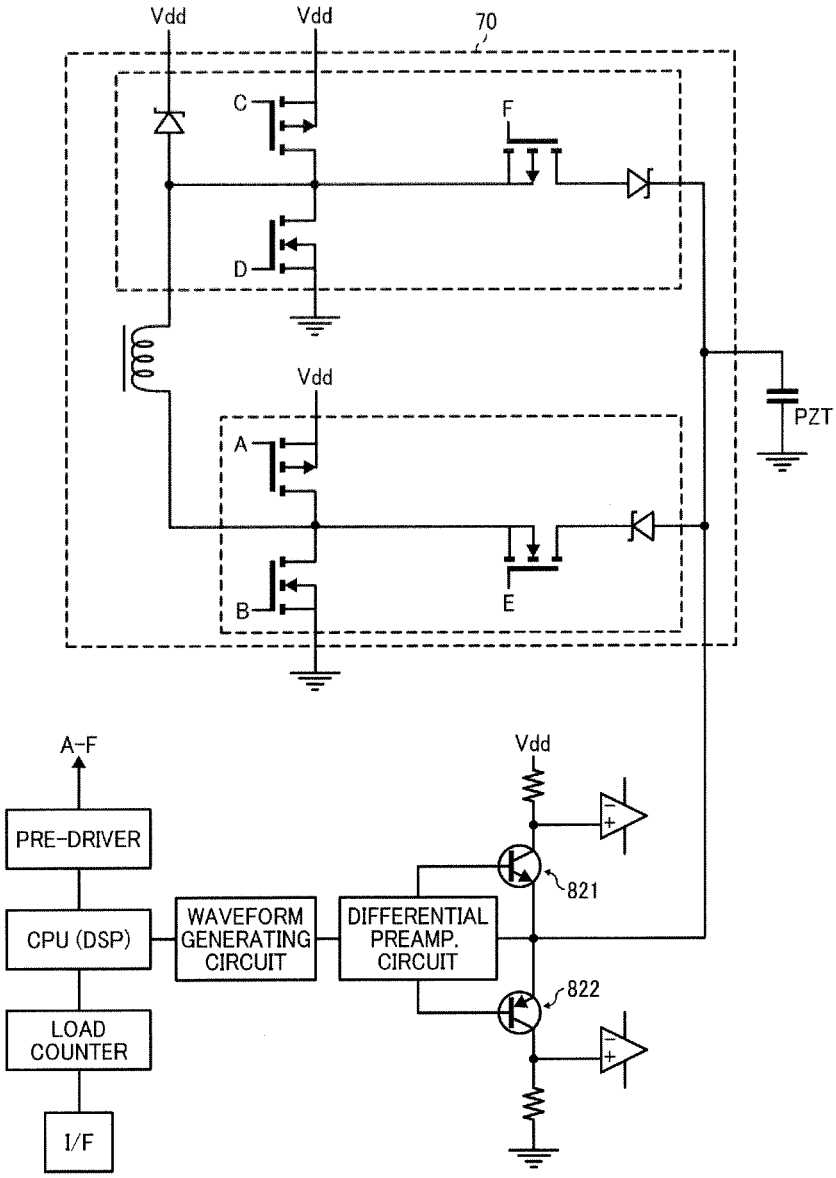
FIG. 7 BACKGROUND ART
FIG. 7 is a block diagram illustrating another example of configuration of a drive signal generator circuit related to the background art.
Figure 8:
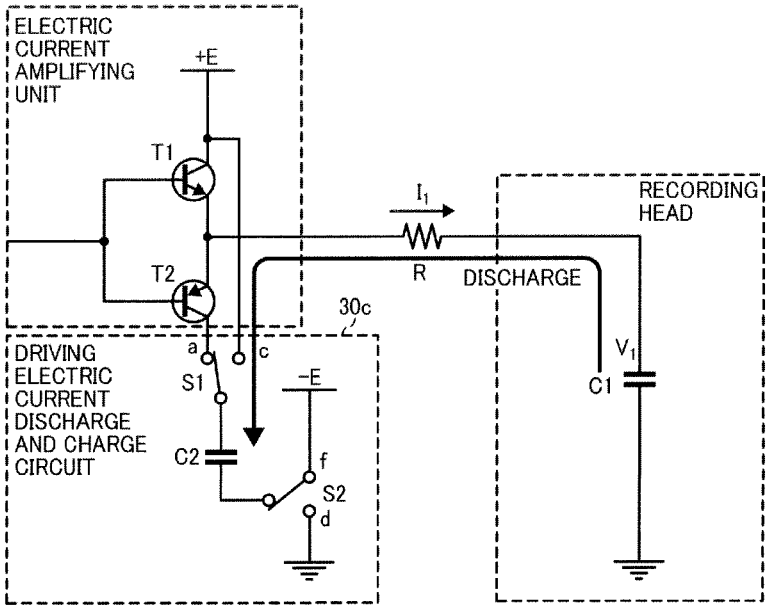
FIG. 8 BACKGROUND ART
FIG. 8 is a block diagram illustrating another example of configuration of a drive signal generator circuit related to the background art.

FIG. 4 is a block diagram illustrating an example of the configuration of the piezoelectric drive circuit 100 related to this variation.

In FIG. 4, the piezoelectric drive circuit 100 related to this variation has a reference signal generating circuit 125 serving as a reference signal generating unit that generates a single reference signal (common reference signal) Vs regulating the waveform of the control signals Vc1 and Vc2 and an FET common drive circuit 126 serving as the control signal output unit that outputs two control signals for both the high side FET 111 and the low side FET 112 based on the single reference signal Vs.

The FET common drive circuit 126 generates two kinds of control signals of the control signals Vc1 for the high side FET 111 and the control signals Vc2 for the low side FET 112 based on the single reference signal (common reference signal) Vs regulating the waveform of the control signal output from the reference signal generating circuit 125 and outputs them to the high side FET 111 and the low side FET 112. This makes it possible to control the high side FET 111 and the low side FET 112.

Since this variation requires only one for each of the reference signal generating circuit 125 and the FET common drive circuit 126, the size of the device shrinks significantly. Moreover, in the FET common drive circuit 126, this facilitates the designing of a protection circuit that prevents the state in which both the high side FET 111 and the low side FET 112 are on simultaneously.

The effects of this embodiment and variation are as follows but are not limited thereto.

In this embodiment and variation, the droplet discharging device 10 has the discharging hole 11 to discharge droplets, the piezoelectric element 12 that is transformed by charge and discharge to discharge the droplets from the discharging hole 11, and the piezoelectric drive circuit 100 that drives the piezoelectric element 12.

The piezoelectric drive circuit 100 has the control signal generating unit 120 that generates the control signals Vc1 and Vc2 controlling the output of the voltage Vp (serving as a drive signal) applied to the piezoelectric element 12 and the drive signal output unit 110 that outputs the drive signal Vp applied to the piezoelectric element 12.

The drive signal output unit 110 has a first field effect transistor (FET for charge) such as the high side FET 111 that operates to supply an electric current to the piezoelectric element 12 based on the control signal Vc1 when charging the piezoelectric element 12 and a second field effect transistor (FET for discharge) such as the low side FET 112 that operates to discharge an electric current from the piezoelectric element 12 based on the control signal Vc2 when discharging the piezoelectric element 12.

As described in the embodiment, in the drive signal output unit 110 of the piezoelectric drive circuit 100, an electric current is supplied to the piezoelectric element 12 by the first field effect transistor operating based on the control signal Vc1 during charging of the piezoelectric element 12.

Furthermore, an electric current is discharged by the second field effect transistor operating based on the control signals Vc2 during discharging of the piezoelectric element 12.

By using the first field effect transistor and the second field effect transistor operating in this manner, no electric current flows at all between the source and the drain on the output side while the voltages of the control signals Vc1 and Vc2 are applied between the gate and the drain on the input side of the drive signal output unit 110, and no voltage is applied at all between the gate and the drain on the input side while an electric current flows between the source and the drain on the output side.

As a consequence, the heat generation in the drive signal output unit 110 of the piezoelectric drive circuit 100 can be reduced to practically nil in comparison with that of a typical transistor.

Moreover, the amount of the heat generation in the piezoelectric drive circuit 100 that drives the piezoelectric element 12 is reduced without adding a new circuit, which obviates the need for a large heat discharging and cooling device.

Consequently, this contributes to manufacturing a compact device.

In addition, since the temperature inside the device is stabilized, the impact on the viscosity of the discharging fluid decreases, so that the diameter of the discharging droplets does not vary greatly.

It is preferable that, in the drive signal output unit 110, the first field effect transistor and the second field effect transistor are connected in a cascade and the drive signal Vp is output to the piezoelectric element 12 from the junction point.

This facilitates the circuit configuration of the drive signal output unit 110 as described in the embodiment.

It is also preferable that the first field effect transistor and the second field effect transistor are the same kind of the field effect transistor.

As described above, in the drive signal output unit of a typical piezoelectric drive circuit, there is a prerequisite that a selected set of different kinds of bipolar transistors of the NPN transistor and the PNP transistor having the identical characteristics with different polarities is used.

However, using the same kind of the field effect transistor for the first field effect transistor and the second field effect transistor as in the present embodiment facilitates the inventory management and leads to the cost reduction.

It is also preferable that the inductor 13 is inserted between the drive signal output unit 110 and the piezoelectric element 12 to apply the drive signal Vp to the piezoelectric element 12 via the inductor 13.

As described in the embodiment, since the inductor 13 inhibits the abrupt inflow and outflow of the electric current, the ringing noise that occurs when the first field effect transistor and the second field effect transistor are turned on can be reduced significantly.

When driving the piezoelectric element 12 on a frequency higher than 100 kHz or higher in particular, the waveform of the drive signal Vp actually applied to the piezoelectric element 12 becomes a trapezoid form or a sine form even if the drive signal output from the drive signal output unit 110.

As a consequence, it is possible to prevent the problem that the durability deteriorates when driving the piezoelectric element 12 on a square waveform.

It is also preferable that when the continuous driving frequency f (Hz) of the drive signal applied to the piezoelectric element 12, the electrostatic capacity Cp (F) of the piezoelectric element 12, and the self inductance of the inductor 13 is L (H), the following relation is satisfied: $1/\{2\cdot(4\pi^2\cdot f^2\cdot Cp)\}\leq L\leq 2/(4\pi^2\cdot f^2\cdot Cp)$ As described in the embodiment, by satisfying the relation, it is possible to apply to the piezoelectric element 12 the drive signal Vp having a good response and noise removability.

It is also preferable that the control signal generating unit 120 has a reference signal generating unit such as the common reference signal generating circuit 125 to generate the single reference signal Vs that regulates the waveforms of the control signals Vc1 and Vc2 and a control signal output unit such as the FET common drive circuit 126 to output the two control signals Vc1 and Vc2 for the first field effect transistor and the second field effect transistor.

As described in the variation 1, since only one unit is required for each of the reference signal generating unit and the control signal unit, which significantly contributes to manufacturing a compact device.

In addition, in the control signal output unit, this facilitates designing a protection circuit that prevents the state in which both the high side FET 111 and the low side FET 112 are on simultaneously.

A particle manufacturing device such as a toner manufacturing device is also provided which has a droplet discharging device to discharge particle component liquid containing particle components such as toner and a solidification drying device such as the chamber 61 that solidifies and dries the droplets discharged from the discharging hole 11.

This particle manufacturing device uses the droplet discharging device 10 mentioned above as the droplet discharging device.

As described in the embodiment, this contributes to manufacturing a compact particulate manufacturing device and makes it possible to manufacture toner having a sharp particle size distribution.

Having now fully described embodiments of the present invention, it will be apparent to one of ordinary skill in the art that many changes and modifications can be made thereto without departing from the spirit and scope of embodiments of the invention as set forth herein.

What is claimed is:

1. A droplet discharging device comprising:

a discharging hole to discharge droplets;

a piezoelectric element that deforms with electrical charging and discharging to discharge droplets from the discharging hole; and a piezoelectric element drive circuit that drives the piezoelectric element to cause the piezoelectric element to charge and discharge, wherein the piezoelectric element drive circuit comprises:

a control signal generating unit to generate a control signal that controls output of a drive signal applied to the piezoelectric circuit; and a drive signal output unit to output the drive signal applied to the piezoelectric element based on the control signal, wherein the drive signal output unit comprises:

a first field effect transistor that operates to supply an electric current to the piezoelectric element based on the control signal when charging the piezoelectric element; and a second field effect transistor that operates to discharge an electric current from the piezoelectric element based on the control signal when discharging the piezoelectric element.

2. The droplet discharging device according to claim 1, wherein, in the drive signal output unit, the first field effect transistor and the second field effect transistor are connected in a cascade to output the drive signal to the piezoelectric element from a junction point in the cascade.

3. The droplet discharging device according to claim 1, wherein the first field effect transistor and the second field effect transistor are the same kind of the field effect transistor.

4. The droplet discharging device according to claim 1, wherein an inductor is inserted between the drive signal output unit and the piezoelectric element, and the drive signal is applied to the piezoelectric element via the inductor.

5. The droplet discharging device according to claim 1, wherein the control signal generating unit comprises:

a reference signal generating unit to generate a single reference signal that regulates waveforms of the control signals; and a control signal output unit to output control signals for the first field effect transistor and the second field effect transistor, respectively, based on the single reference signal generated by the reference signal generating unit.

6. A particle manufacturing device comprising:

the droplet discharging device of claim 1 to discharge particle component liquid comprising particle components; and a solidification drying device to solidify and dry droplets of the particle component liquid discharged from the discharging hole.

7. A droplet discharging device comprising:

a discharging hole to discharge droplets;

a piezoelectric element that deforms with electrical charging and discharging to discharge droplets from the discharging hole; and a piezoelectric element drive circuit that drives the piezoelectric element to cause the piezoelectric element to charge and discharge, wherein the piezoelectric element drive circuit comprises:

a control signal generating unit to generate a control signal that controls output of a drive signal applied to the piezoelectric circuit; and a drive signal output unit to output the drive signal applied to the piezoelectric element based on the control signal wherein the drive signal output unit comprises;

a first field effect transistor that operates to supply an electric current to the piezoelectric element based on the control signal when charging the piezoelectric element; and a second field effect transistor that operates to discharge an electric current from the piezoelectric element based on the control signal when discharging the piezoelectric element, wherein an inductor is inserted between the drive signal output unit and the piezoelectric element, and the drive signal is applied to the piezoelectric element via the inductor, and wherein the droplet discharging device satisfies the following relation:

$$1/\{2\cdot(4\pi^2\cdot f^2\cdot Cp)\}\leq L\leq 2/(4\pi^2\cdot f^2\cdot Cp)$$

where f (Hz) represents a continuous driving frequency of the drive signal applied to the piezoelectric element, Cp (F) represents an electrostatic capacity of the piezoelectric element, and L (H) represents a self inductance of the inductor.

8. A droplet discharging device comprising:

a discharging hole to discharge droplets;

a piezoelectric element that deforms with electrical charging and discharging to discharge droplets from the discharging hole; and a piezoelectric element drive circuit that drives the piezoelectric element to cause the piezoelectric element to charge and discharge, wherein the piezoelectric element drive circuit comprises:

a control signal generating unit to generate first and second control signals; and a drive signal output unit to output a drive signal applied to the piezoelectric element, wherein the drive signal output unit comprises:

a first field effect transistor that operates to supply an electric current to the piezoelectric element based on the first control signal supplied to a gate of the first field effect transistor, when charging the piezoelectric element; and a second field effect transistor that operates to discharge an electric current from the piezoelectric element based on the second control signal supplied to a gate of the second field effect transistor, when discharging the piezoelectric element, wherein the control signal generating unit controls timing of the first and second control signals to avoid the first field effect transistor and the second field effect transistor being on simultaneously.

9. The droplet discharging device according to claim 8, wherein the control signal generating unit comprises:

a reference signal generating unit to generate a single reference signal that regulates waveforms of the first and second control signals; and a control signal output unit to output the first and second control signals to the first field effect transistor and the second field effect transistor, respectively, based on the single reference signal generated by the reference signal generating unit.

10. The droplet discharging device according to claim 8, wherein, in the drive signal output unit, the first field effect transistor and the second field effect transistor are connected in a cascade to output the drive signal to the piezoelectric element from a junction point in the cascade.

11. The droplet discharging device according to claim 8, wherein the first field effect transistor and the second field effect transistor are the same kind of the field effect transistor.

12. The droplet discharging device according to claim 8, wherein an inductor is inserted between the drive signal output unit and the piezoelectric element, and the drive signal is applied to the piezoelectric element via the inductor.

13. A particle manufacturing device comprising:

the droplet discharging device of claim 8 to discharge particle component liquid comprising particle components; and a solidification drying device to solidify and dry droplets of the particle component liquid discharged from the discharging hole.

* * * * *